US009779660B2

(12) United States Patent
Yao

(10) Patent No.: US 9,779,660 B2
(45) Date of Patent: Oct. 3, 2017

(54) PIXEL UNIT DRIVING CIRCUIT, DRIVING METHOD AND PIXEL CELL

(71) Applicant: Shenzhen China Star Optoelectronics Technology Co. Ltd., Shenzhen, Guangdong (CN)

(72) Inventor: Jiangbo Yao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 90 days.

(21) Appl. No.: 14/761,344

(22) PCT Filed: May 12, 2015

(86) PCT No.: PCT/CN2015/078746
§ 371 (c)(1),
(2) Date: Jul. 16, 2015

(65) Prior Publication Data

US 2016/0329018 A1 Nov. 10, 2016

(30) Foreign Application Priority Data

May 7, 2015 (CN) ..... 2015 1 0229135

(51) Int. Cl.
*G09G 3/32* (2016.01)
*G09G 3/3233* (2016.01)

(52) U.S. Cl.
CPC ... *G09G 3/3233* (2013.01); *G09G 2300/0842* (2013.01); *G09G 2320/0214* (2013.01); *G09G 2320/0223* (2013.01); *G09G 2320/0247* (2013.01)

(58) Field of Classification Search
None
See application file for complete search history.

(56) References Cited

U.S. PATENT DOCUMENTS

2015/0364082 A1* 12/2015 Gu ..... G09G 3/3225 345/211
2015/0371586 A1* 12/2015 Chen ..... G09G 3/3258 345/78
2016/0063924 A1* 3/2016 Oh ..... H01L 27/1229 345/690
2016/0232849 A1* 8/2016 Jeon ..... G09G 3/3233

* cited by examiner

*Primary Examiner* — Joseph Haley
*Assistant Examiner* — Emily Frank
(74) *Attorney, Agent, or Firm* — Andrew C. Cheng

(57) ABSTRACT

A pixel cell driving circuit driving an organic electric lighting component comprises a first, a second and a third thin film transistors and a storage capacitor. The first thin film transistor is turned on or turned off under a control of a first scanning signal. When the first thin film transistor is turned on, the storage capacitor is charged by a data signal. The second thin film transistor is turned on under an action of the storage capacitor and drives an OLED. The third thin film transistor is turned on under a control of the second scanning signal when the first thin film transistor is turned off, and the storage capacitor is charged by a charging signal. The pixel cell driving circuit may effectively avoid the flicker due to the electrical charge leakage of the storage capacitor. The disclosure further provides a pixel cell and a pixel cell driving method.

17 Claims, 6 Drawing Sheets

PIXEL UNIT DRIVING CIRCUIT, DRIVING METHOD AND PIXEL CELL

CROSS REFERENCE TO RELATED APPLICATION

This invention claims priority under 35 U.S.C. 119 from China Application No. 201510229135.X, titled "Pixel Unit Driving Circuit, Driving Method and Pixel Cell", filed May 7, 2015, the entire contents of which are incorporated herein by reference in its entirety.

BACKGROUND

Technical Field

The disclosure is related to liquid crystal display technology field, and more particular to a pixel cell driving circuit, a driving method and a pixel cell.

Related Art

The organic light-emitting diode (OLED) display panel, also known as the organic electric lighting display device, is an emerging flat-panel display component. The OLED display panel has the characteristics of simple preparation process, low cost, low power consumption, high lighting brightness, wide operating temperature range, light volume, and fast response. It is easy for the OLED display panel to implement a color display, a large screen display, and a flexible display and to match with the integrated circuit driver. Therefore in the flat-panel display field the OLED display panel has been widely used.

The pixel cells in the OLED display panel are typically arranged in a matrix, and according to the different driving manner, the OLED can be divided into two kinds as a passive-matrix OLED (PM-OLED) driving display panel and an active-matrix OLED (AM-OLED) driving display panel. Although the PM-OLED driving display panel has the simple process and low cost, but it exists the crossfeed, high power consumption, low life expectancy and other shortcomings. Therefore it is unable to meet the requirement of the high-resolution, and large-sized display. In contrast with the PM-OLED, each of the pixel cells in the AM-OLED driving display panel is equipped with a set of pixel cell driving circuit composed by a thin film transistor (TFT) and a storage capacitor and the control of the current of the OLED may be realized by controlling the TFT to turn on or turn off, thereby controlling the OLED to emit light. Since the driving circuit adds the TFT and the storage capacitor, such that the OLED in each of the pixel cells is able to emit light within a controllable frame time, and the driving circuit has small required driving current, low power consumption, and longer life, thereby meeting the requirement of the high-resolution, multi-gray scale, and large-sized display.

FIG. 1 is a schematic view of the pixel cell driving circuit of the OLED display device according to the current technology. T1 is the switch thin film transistor, T2 is the drive thin film transistor, Cs is the storage capacitor, the scanning line is used to provide the scanning signal, and the data line is used to provide the data signal. When the scanning signal provided by the scanning line is high level, a fixed voltage is applied to the gate g1 of the switch thin film transistor T1, such that the switch thin film transistor T1 enters a turn-on state, a voltage difference between the source s1 and the drain d1 of the switch thin film transistor T1 decrease to a small value, and the switch thin film transistor T1 may be similar to a short-circuited state. The data signal provided by the data line stores on the storage capacitor Cs through the switch thin film transistor T1, i.e. the storage capacitor Cs is charged. The thin film transistor T2 is connected to one terminal of the storage capacitor Cs, when the voltage of one terminal of the storage capacitor Cs is achieved to a turn-on voltage of the drive thin film transistor T2, the drive thin film transistor T2 is turned on to drive the OLED to emit light. When the scanning signal provided by the scanning line is low level, the switch thin film transistor T1 is at turn-off state; however, since the leakage current exists in the switch thin film transistor T1, the electrical charge on the storage capacitor Cs leaks to the data line along the switch thin film transistor T1 when the switch transistor T1 is at the turn-off state, such that the voltage of the storage capacitor Cs is dropped gradually, i.e. the transition voltage (as shown in FIG. 2) exists, and thus the voltage of the gate g2 of the drive thin film transistor T2 is dropped excessively when the switch thin film transistor T1 is at turn-off state, so as to cause the OLED display panel to flicker.

SUMMARY

The disclosure provides a pixel cell driving circuit which adds a charging signal to charge the storage capacitor when the switch thin film transistor is turned off, so as to avoid the flicker due to the electrical charge leakage which results in the storage capacitor voltage being unstable.

Additionally, the disclosure further provides a pixel cell used to the pixel cell driving circuit which adds a charging line to provide the charging signal and charge the storage capacitor when the switch thin film transistor is turned off, so as to avoid the flicker due to the electrical charge leakage which results in the storage capacitor voltage being unstable and to enhance the stability of the pixel cell.

Additionally, the disclosure further provides a pixel cell driving method used to the pixel cell driving circuit which provides the charging signal to charge the storage capacitor when the switch thin film transistor is turned off, so as to avoid the flicker due to the electrical charge leakage which results in the storage capacitor voltage being unstable and to enhance the display quality.

A pixel cell driving circuit is used to drive an organic electric lighting component. The pixel cell driving circuit includes a first thin film transistor, a second thin film transistor, a third thin film transistor and a storage capacitor; the first thin film transistor is turned on or turned off under a control of a first scanning signal, when the first thin film transistor is turned on; the storage capacitor is charged by a data signal; the second thin film transistor is turned on under an action of the storage capacitor and drives an organic light-emitting diode (OLED) to emit light; the third thin film transistor is turned on under a control of the second scanning signal when the first thin film transistor is turned off, and the storage capacitor is charged by a charging signal.

In one embodiment, the first thin film transistor includes a first gate, a first source and a first drain; the second thin film transistor includes a second gate, a second source and a second drain; the third thin film transistor includes a third gate, a third source and a third drain; the first gate is used to receive the first scanning signal; the first source is used to receive the data signal; the first drain is connected to the second gate, the third drain and one terminal of the storage capacitor; the other terminal of the storage capacitor is connected to the second drain, the second source is connected to one terminal of the OLED, and the other terminal of the OLED is connected to a ground; the third drain is connected to the second gate and the terminal of the storage capacitor; the third gate is used to receive the second scanning signal; the third source is used to receive the charging signal.

In one embodiment, the pixel cell driving circuit further includes a power source; the power source is connected to the second drain and is used to provide a driving voltage to the pixel cell driving circuit.

In one embodiment, the first scanning signal and the data signal are synchronized with each other, the second scanning signal and the charging signal are synchronized with each other; each of a period of the first scanning signal, the second scanning signal, the data signal and the charging signal is one frame period of the pixel cell.

In one embodiment, the second scanning signal relative to the first scanning signal has a first delay time, and the charging signal relative to the data signal has a second delay time.

In one embodiment, the first delay time equals to the second delay time, and the first delay time and the second delay time are less than or equal to ¾ frame period of the pixel cell.

A pixel cell includes a first scanning line and a data line, wherein the pixel cell further includes a second scanning line, a charging line, and a pixel cell driving circuit; the pixel cell driving circuit includes a first thin film transistor, a second thin film transistor, a third thin film transistor and a storage capacitor; the first thin film transistor is turned on or turned off under a control of a first scanning signal, when the first thin film transistor is turned on; the storage capacitor is charged by a data signal; the second thin film transistor is turned on under an action of the storage capacitor and drives an organic light-emitting diode (OLED) to emit light; the third thin film transistor is turned on under a control of the second scanning signal when the first thin film transistor is turned off, and the storage capacitor is charged by a charging signal.

In one embodiment, the first thin film transistor includes a first gate, a first source and a first drain; the second thin film transistor includes a second gate, a second source and a second drain; the third thin film transistor includes a third gate, a third source and a third drain; the first gate is connected to the first scanning line; the first source is connected to the data line; the first drain is connected to the second gate, the third drain and one terminal of the storage capacitor; the other terminal of the storage capacitor is connected to the second drain; the second source is connected to one terminal of the OLED; the other terminal of the OLED is connected to a ground; the third drain is connected to the second gate and the terminal of the storage capacitor; the third gate is connected to the second scanning line; the third source is connected to the charging line.

In one embodiment, the first scanning line is used to provide a first scanning signal, the second scanning line is used to provide a second scanning signal, the data line is used to provide data signal, the charging line is used to provide a charging signal, the second scanning signal relative to the first scanning signal has a first delay time, and the charging signal relative to the data signal has a second delay time.

In one embodiment, the first scanning signal and the data signal are synchronized with each other, the second scanning signal and the charging signal are synchronized each other, each of a period of the first scanning signal, the second scanning signal, and the data signal and the charging signal is one frame period of the pixel cell.

In one embodiment, the first delay time equals to the second delay time, and the first delay time and the second delay time are less than or equal to ¾ frame period of the pixel cell.

In one embodiment, the pixel cell driving circuit further includes a power source; the power source is connected to the second drain and is used to provide a driving voltage to the pixel cell driving circuit.

A pixel cell driving method includes:

providing a first scanning signal, a second scanning signal, a data signal and a charging signal;

the first thin film transistor is turned on under an action of the first scanning signal, such that the data signal charges the storage capacitor through the first thin film transistor;

when a voltage of one terminal of the storage capacitor connected to the second gate of the second thin film transistor achieves to a turn-on voltage of the second thin film transistor, the second thin film transistor is turned on, so as to drive an organic light-emitting diode (OLED) to emit light;

the first thin film transistor is turned off under an action of the first scanning signal, the storage capacitor continues to maintain the second thin film transistor turned on, so as to drive the OLED to emit light;

after the first thin film transistor is turned off for a predetermined time, the third thin film transistor is turned on under an action of the second scanning signal, such that the charging signal charges the storage capacitor through the third thin film transistor.

In one embodiment, the first scanning signal and the data signal are synchronized with each other; the second scanning signal and the charging signal are synchronized with each other; each of a period of the first scanning signal, the second scanning signal, the data signal and the charging signal is one frame period of the pixel cell.

In one embodiment, the second scanning signal relative to the first scanning signal has a first delay time, and the charging signal relative to the data signal has a second delay time.

In one embodiment, the first delay time equals to the second delay time, and the first delay time and the second delay time are less than or equal to ¾ frame period of the pixel cell.

In one embodiment, the predetermined time equals to the first delay time or the second delay time.

The pixel cell driving circuit of the disclosure provides the charging signal delayed for ¾ frame period relative to the data signal and the second scanning signal delayed for ¾ frame period relative to the first scanning signal to control the third thin film transistor to turn on or turn off, and when the first thin film transistor is turned off, the second scanning signal controls the third thin film transistor to turn on, such that the charging signal charges the storage capacitor through the third thin film transistor to avoid the flicker due to the electrical charge leakage which results in the storage capacitor voltage being unstable during the first thin film transistor is turned off.

BRIEF DESCRIPTION OF THE DRAWINGS

The above and other exemplary aspects, features and advantages of certain exemplary embodiments of the present disclosure will be more apparent from the following description taken in conjunction with the accompanying drawings, in which.

DETAILED DESCRIPTION

The following description with reference to the accompanying drawings is provided to clearly and completely explain the exemplary embodiments of the disclosure. It is apparent that the following embodiments are merely some embodiments of the disclosure rather than all embodiments of the disclosure. According to the embodiments in the disclosure, all the other embodiments attainable by those skilled in the art without creative endeavor belong to the protection scope of the disclosure.

Figure 1:
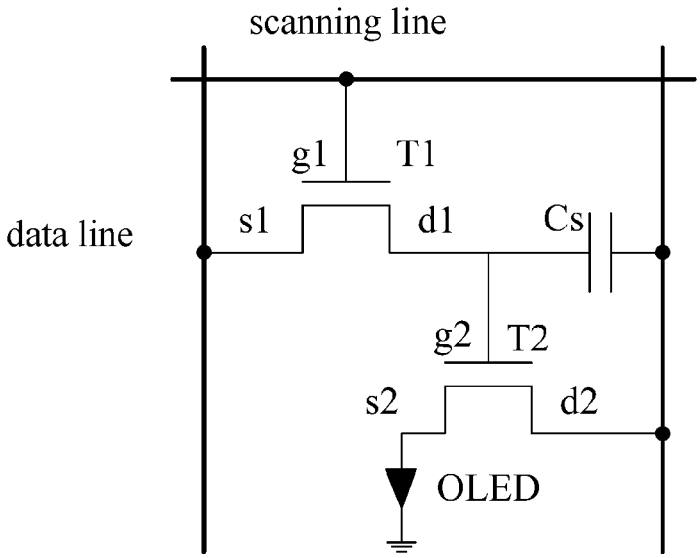
Fig. 1 (Prior Art)
FIG. 1 is a schematic view of the pixel cell driving circuit of the OLED displayer according to the current technology.
Figure 2:
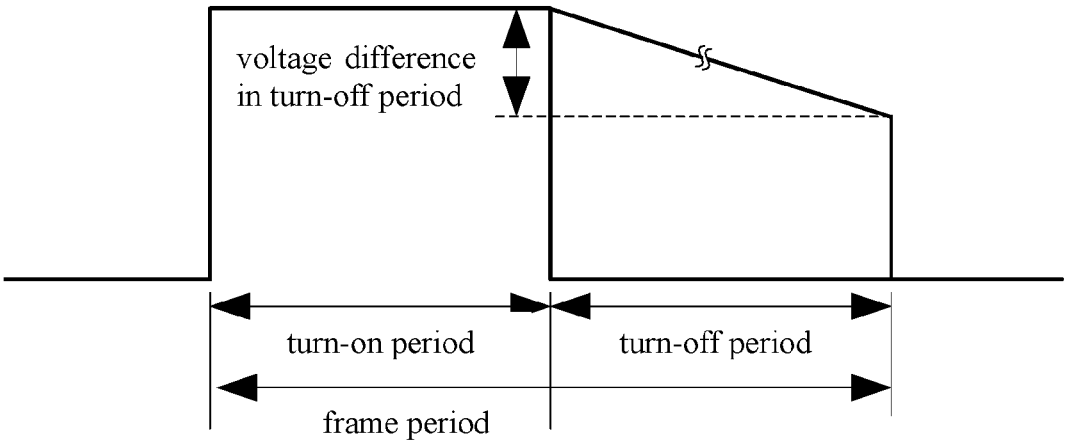
Fig. 2 (Prior Art)
FIG. 2 is a schematic view of a transition voltage of the storage capacitor of the pixel cell driving circuit in FIG. 1 during one frame period.
Figure 3:
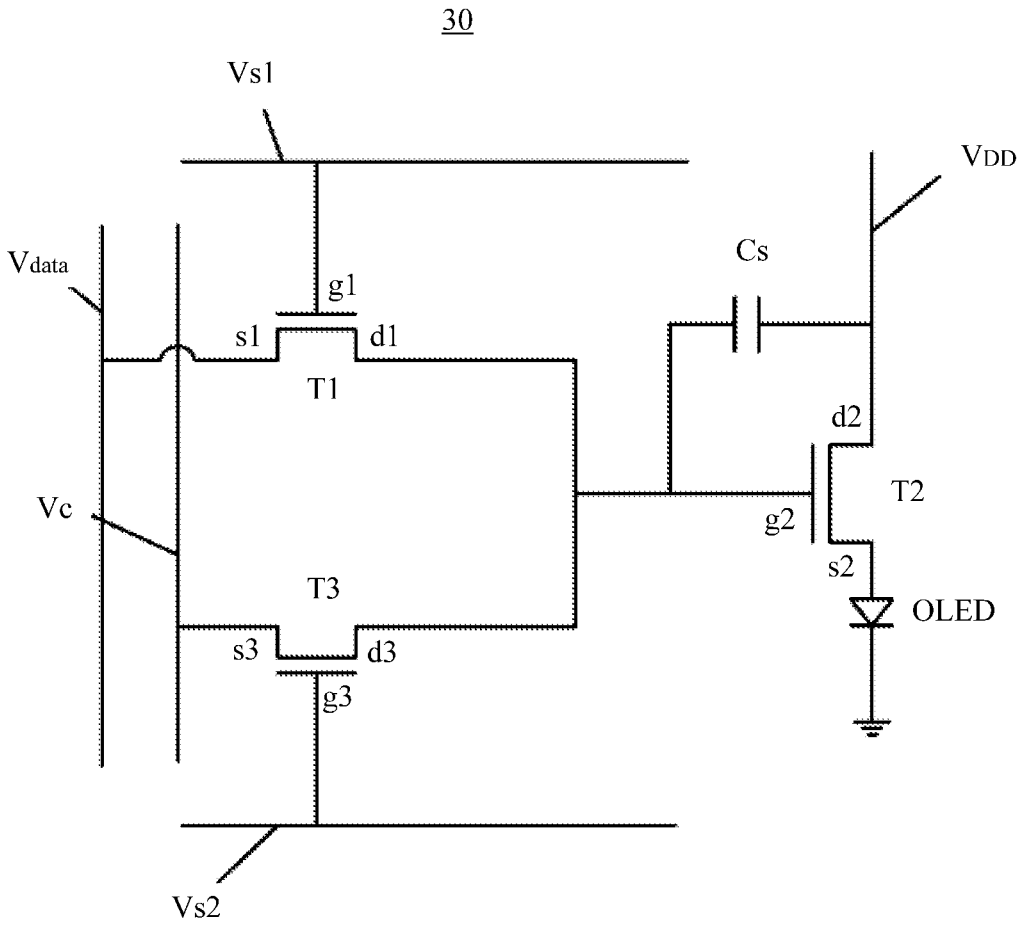
FIG. 3 is a schematic view of the pixel cell driving circuit according to the first embodiment of the disclosure.

Refer to FIG. 3. The first embodiment of the disclosure provides a pixel cell driving circuit 30 used to drive an organic electric lighting component, which includes a power source VDD, a first thin film transistor (TFT) T1, a second thin film transistor T2, a third thin film transistor T3 and a storage capacitor Cs. The first thin film transistor T1 is a switch TFT, which is turned on or turned off under a control of a first scanning signal Vs1, and when the first thin film transistor T1 is turned on, the storage capacitor Cs is charged by a data signal Vdata. The second thin film transistor T2 is a driving TFT, which is turned on under an action of the storage capacitor Cs and drives an organic light-emitting diode (OLED) to emit light. The third thin film transistor T3 is turned on or turned off under a control of the second scanning signal Vs2 and when the third thin film transistor T3 is turned on, the storage capacitor Cs is charged by a charging signal Vc.

The first thin film transistor T1 includes a first gate g1, a first source s1 and a first drain d1. The second thin film transistor T2 includes a second gate g2, a second source s2 and a second drain d2. The third thin film transistor T3 includes a third gate g3, a third source s3 and a third drain d3. The first gate g1 is used to receive the first scanning signal Vs1. The first source s1 is used to receive the data signal Vdata. The first drain d1 is connected to the second gate g2, the third drain d3 and one terminal of the storage capacitor Cs, the other terminal of the storage capacitor Cs is connected to the power source VDD and the second drain d2, i.e. the storage capacitor Cs is connected between the second gate g2 and the second drain d2. The second source s2 is connected to one terminal of the OLED; the other terminal of the OLED is connected to a ground. The third drain d3 is connected to the second gate g2 and the terminal of the storage capacitor Cs, and the third gate g3 is used to receive the second scanning signal Vs2. The third source s3 is used to receive the charging signal Vc.

Figure 4:
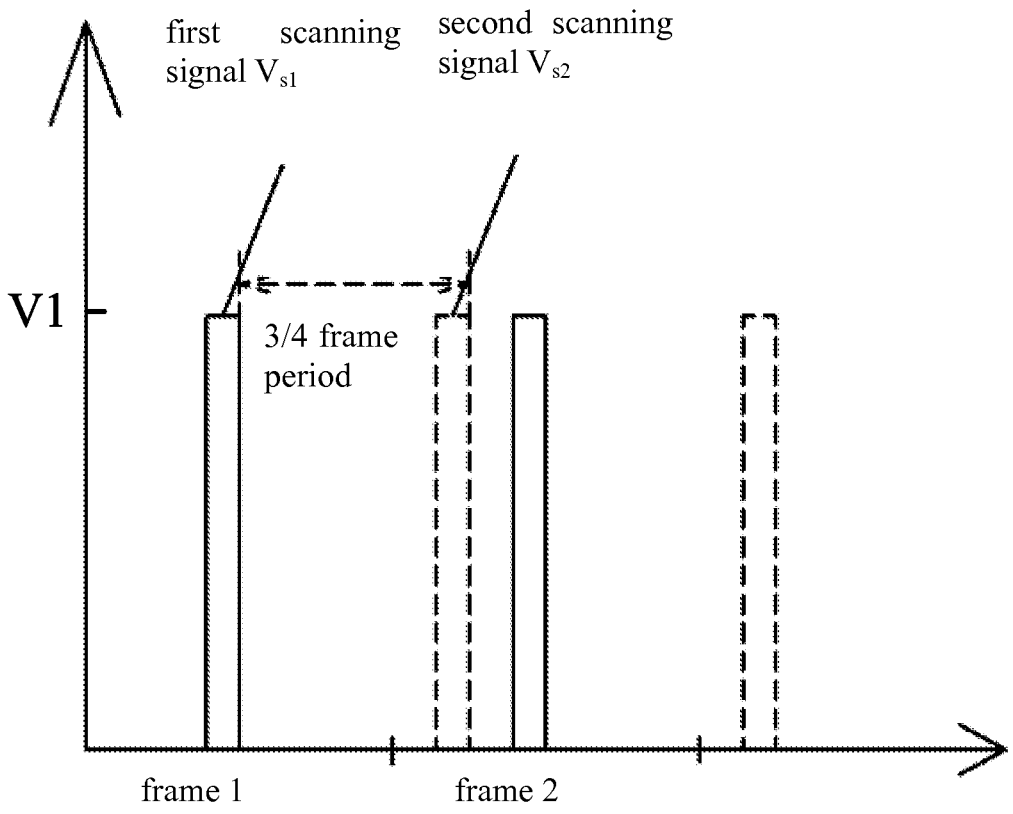
FIG. 4 is a relationship schematic view of the first scanning signal and the second scanning signal of the pixel cell driving circuit in FIG. 3.

Refer to FIG. 4. The first scanning signal Vs1 and the second scanning signal Vs2 are a period signal with the same waveform, and the second scanning signal Vs2 relative to the first scanning signal Vs1 has a first delay time. In this embodiment, a period of the first scanning signal Vs1 and the second scanning signal Vs2 is one frame period and has the same peak value V1. The first delay time is ¾ frame period. It is understood that the first delay time is further less than ¾ frame period, such as ⅔ frame period, ⅗ frame period, ½ frame period and so on.

Figure 5:
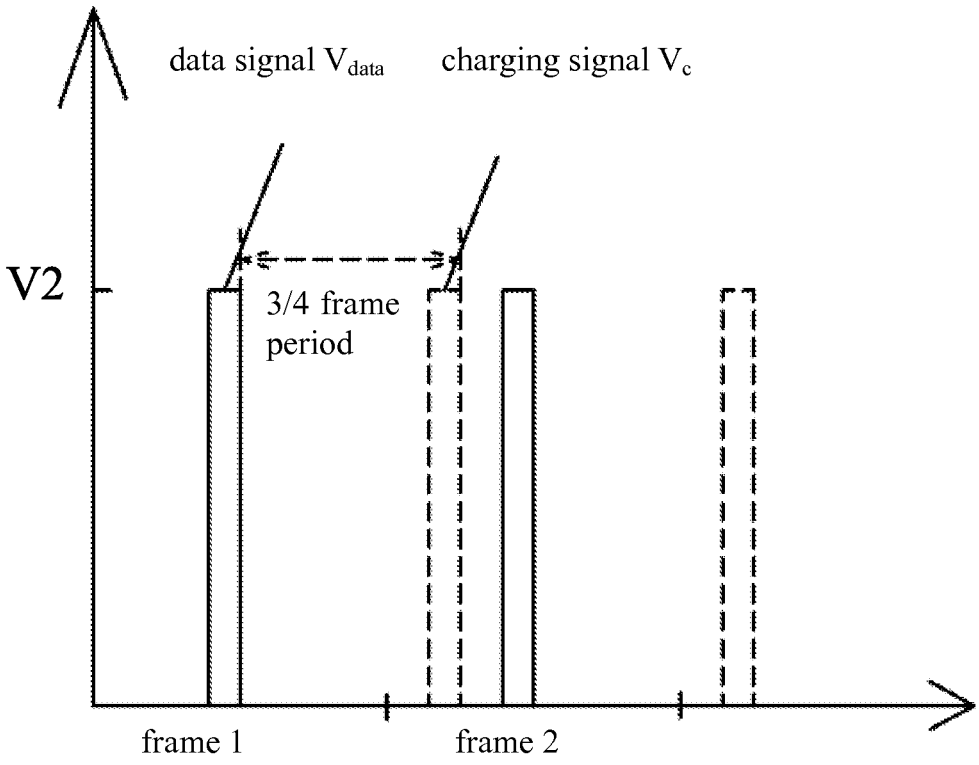
FIG. 5 is a relationship schematic view of the data signal and the charging signal of the pixel cell driving circuit in FIG. 3.

Refer to FIG. 5. The data signal Vdata and the charging signal Vc are a period signal with the same waveform, and the charging signal Vc relative to the data signal Vdata has a second delay time. In this embodiment, a period of the data signal Vdata and the charging signal Vc is one frame period and has the same peak value V2. The second delay time is ¾ frame period. It is understood that the second delay time is further less than ¾ frame period, such as ⅔ frame period, ⅗ frame period, ½ frame period and so on.

In this embodiment, the first scanning signal Vs1 and the data signal Vdata are synchronized with each other, the second scanning signal Vs2 and the charging signal Vc are synchronized with each other. Namely, the first delay time equals to the second delay time, and both of the first delay time and the second delay time are set less than or equal to ¾ frame period.

The operation principle of the pixel cell driving circuit 30 is further illustrated in connection with FIG. 3 to FIG. 5 as below, and the first delay time is set as ¾ frame period and the second delay time is set as ¾ frame period will be described.

When the first scanning signal Vs1 is high level, the first thin film transistor T1 is turned on under the action of the first scanning signal Vs1, the data signal Vdata charges the storage capacitor Cs through the first thin film transistor T1. The third thin film transistor T3 is turned off under the action of the second scanning signal Vs2. When a voltage of one terminal of the storage capacitor Cs connected to the second gate g2 achieves to a turn-on voltage of the second thin film transistor T2, the second thin film transistor T2 is turned on, so as to drive the OLED to emit light.

When the first scanning signal Vs1 is low level, the first thin film transistor T1 is turned off under the action of the first scanning signal Vs1. The second thin film transistor T2 is turned on under the action of the storage capacitor Cs to drive the OLED for emitting light. Since the leakage current exists in the first thin film transistor T1, the electrical charge on the storage capacitor Cs leaks to the data line along the first thin film transistor T1 when the first scanning signal Vs1 is low level, such that the voltage of the storage capacitor Cs is dropped gradually. In order to avoid the OLED flicker due to the voltage of the storage capacitor Cs dropped excessively, after the first thin film transistor T1 is turned off for a predetermined time, the third thin film transistor T3 is turned on under the action of the second scanning signal Vs2, such that the charging signal Vc charges the storage capacitor Cs through the third thin film transistor T3, thereby ensuring the storage capacitor Cs being able to provide sufficient voltage to drive the OLED to continue emitting light stably until the first scanning signal Vs1 changes to high level, and then repeats the above process. In one embodiment, the predetermined time is less than or equals to ¾ frame period of the pixel cell.

The pixel cell driving circuit 30 provides the charging signal Vc delayed for ¾ frame period relative to the data signal Vdata and the second scanning signal Vs2 delayed for ¾ frame period relative to the first scanning signal Vs1 to control the third thin film transistor T3 to turn on or turn off, and when the first scanning signal Vs1 is low level, the second scanning signal Vs2 controls the third thin film transistor T3 to turn on, such that the charging signal Vc charges the storage capacitor Cs through the third thin film transistor T3 to avoid the flicker due to the electrical charge leakage which results in the storage capacitor Cs voltage being unstable when the first thin film transistor T1 is turned off.

Figure 6:
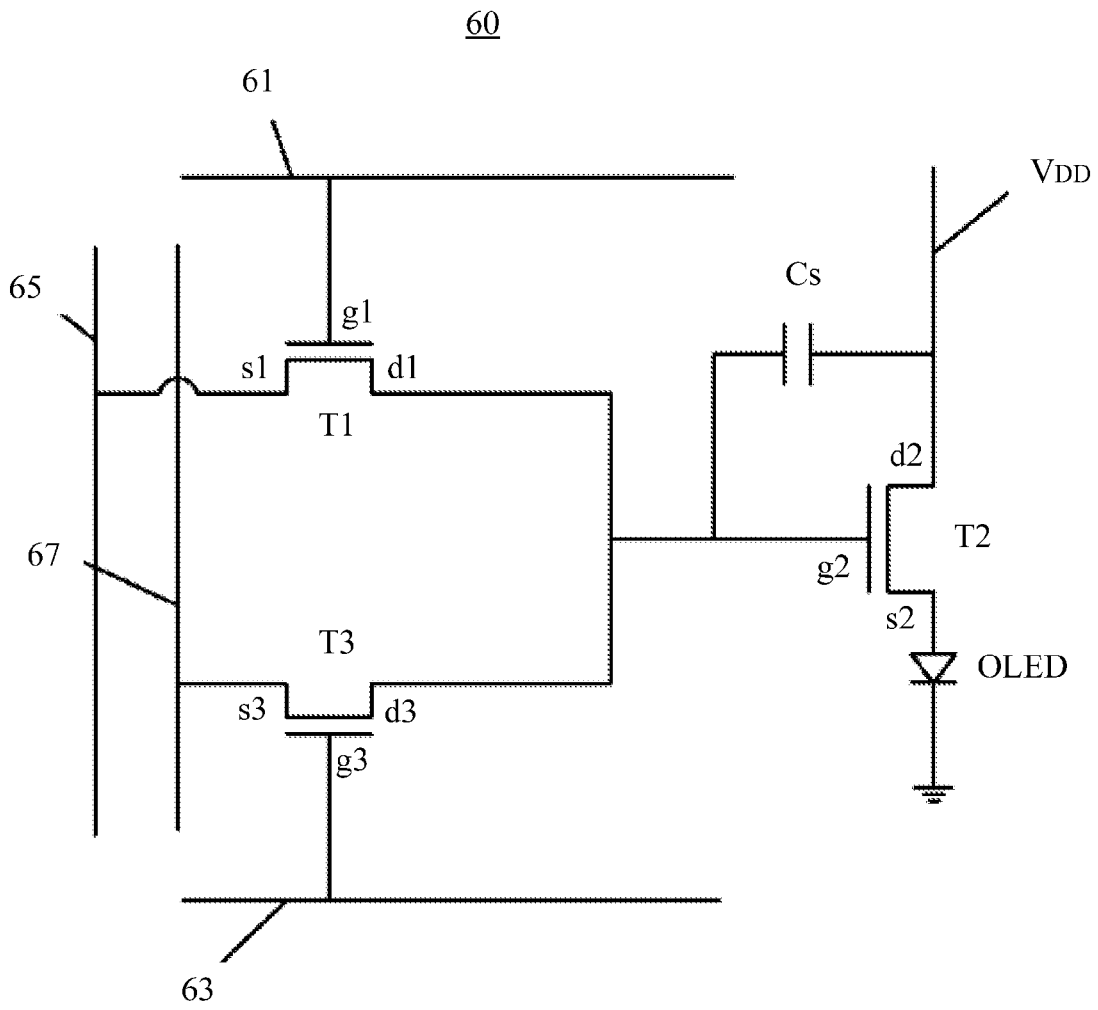
FIG. 6 is a schematic view of the pixel cell according to the second embodiment of the disclosure.

Refer to FIG. 6, the second embodiment of the disclosure provides a pixel cell 60 used to the above pixel cell driving circuit 30. The pixel cell 60 includes a first scanning line 61, a second scanning line 63, a data line 65, a charging line 67, a power source VDD, a first thin film transistor (TFT) T1, a second thin film transistor T2, a third thin film transistor T3, a storage capacitor Cs and an organic light-emitting diode (OLED). The first scanning line 61 is used to provide a first scanning signal Vs1. The second scanning line 63 is used to provide a second scanning signal Vs2. The data line 65 is used to provide data signal Vdata. The charging line 67 is used to provide a charging signal Vc. The power source VDD is used to provide a driving voltage to the pixel cell 60. The first thin film transistor T1 is a switch TFT, which is connected to the first scanning line 61 and the data line 65, and turns on or turns off under the control of a first scanning signal Vs1, when the first thin film transistor T1 is turned on. The data signal Vdata charges the storage capacitor Cs through the first thin film transistor T1. The second thin film transistor T2 is a driving transistor, which is connected to the first thin film transistor T1, the power source VDD and the storage capacitor Cs and is used to turn on under the action of the storage capacitor Cs and to drive the OLED to emit light. The third thin film transistor T3 is connected to the first thin film transistor T1, the second thin film transistor T2, the charging line 67 and the second scanning line 63, the third thin film transistor T3 is turned on or turned off under the control of the second scanning signal Vs2, and when the third thin film transistor T3 is turned on, the charging signal Vc charges the storage capacitor Cs through the third thin film transistor T3.

The first thin film transistor T1 includes a first gate g1, a first source s1 and a first drain d1. The second thin film transistor T2 includes a second gate g2, a second source s2 and a second drain d2. The third thin film transistor T3 includes a third gate g3, a third source s3 and a third drain d3. The first gate g1 is connected to the first scanning line 61. The first source s1 is connected to the data line 65. The first drain d1 is connected to the second gate g2, the third drain d3 and one terminal of the storage capacitor Cs. The other terminal of the storage capacitor Cs is connected to the power source VDD and the second drain d2, i.e. the storage capacitor Cs is connected between the second drain d2 and the second gate g2. The second source s2 is connected to one terminal of the OLED, and the other terminal of the OLED is connected to a ground. The third drain d3 is connected to the second gate g2 and the terminal of the storage capacitor Cs, the third gate g3 is connected to the second scanning line 63, and the third source s3 is connected to the charging line 67.

In one embodiment, the first scanning signal Vs1 and the second scanning signal Vs2 are a periodical signal with the same waveform, and the second scanning signal Vs2 relative to the first scanning signal Vs1 has a first delay time. In this embodiment, a period of the first scanning signal Vs1 and the second scanning signal Vs2 is one frame period of the pixel cell 60 and has the same peak value V1. The first delay time is ¾ frame period. It is understood that the first delay time is further less than ¾ frame period, such as ⅔ frame period, ⅗ frame period, ½ frame period and so on.

In one embodiment, the data signal Vdata and the charging signal Vc are a periodical signal with the same waveform, and the charging signal Vc relative to the data signal Vdata has a second delay time. In this embodiment, a period of the data signal Vdata and charging signal Vc is one frame period of the pixel cell 60 and has the same peak value V2. The second delay time is ¾ frame period. It is understood that the second delay time is further less than ¾ frame period, such as ⅔ frame period, ⅗ frame period, ½ frame period and so on.

In this embodiment, the first scanning signal Vs1 and the data signal Vdata are synchronized with each other, the second scanning signal Vs2 and the charging signal Vc are synchronized with each other. Namely, the first delay time equals to the second delay time, and both of the first delay time and the second delay time are set less than or equal to ¾ frame period.

When the first scanning signal Vs1 is high level, the first thin film transistor T1 is turned on under the action of the first scanning signal Vs1. The data signal Vdata charges the storage capacitor Cs through the first thin film transistor T1. The third thin film transistor T3 is turned off under the action of the second scanning signal Vs2. When a voltage of one terminal of the storage capacitor Cs connected to the second gate g2 achieves to a turn-on voltage of the second thin film transistor T2, the second thin film transistor T2 is turned on, so as to drive the OLED to emit light.

When the first scanning signal Vs1 is low level, the first thin film transistor T1 is turned off under the action of the first scanning signal Vs1. The second thin film transistor T2 is turned on under the action of the storage capacitor Cs to drive the OLED for emitting light. Since the leakage current exists in the first thin film transistor T1, the electrical charge on the storage capacitor Cs leaks to the data line along the first thin film transistor T1 when the first scanning signal Vs1 is low level, such that the voltage of the storage capacitor Cs is dropped gradually. In order to avoid the OLED flicker due to the voltage of the storage capacitor Cs dropped excessively, after the first thin film transistor T1 is turned off for a predetermined time, the third thin film transistor T3 is turned on under the action of the second scanning signal Vs2, such that the charging signal Vc charges the storage capacitor Cs through the third thin film transistor T3, thereby ensuring the storage capacitor Cs able to provide sufficient voltage to drive the OLED to continue emitting light stably until the first scanning signal Vs1 changes to high level, and then repeats the above process. In one embodiment, the predetermined time is less than or equals to ¾ frame period of the pixel cell.

The pixel cell 60 adds the charging line 67 to provide the charging signal Vc, sets the charging signal Vc as the data signal Vdata delayed for ¾ frame period and provides the second scanning signal Vs2 delayed fir ¾ frame period relative to the first scanning signal Vs1 to control the third thin film transistor T3 to turn on or turn off, and when the first scanning signal Vs1 is low level, the second scanning signal Vs2 controls the third thin film transistor T3 to turn on, such that the charging signal Vc charges the storage capacitor Cs through the third thin film transistor T3 to avoid the flicker due to the electrical charge leakage which results in the storage capacitor Cs voltage being unstable when the first thin film transistor T1 is turned off.

Figure 7:
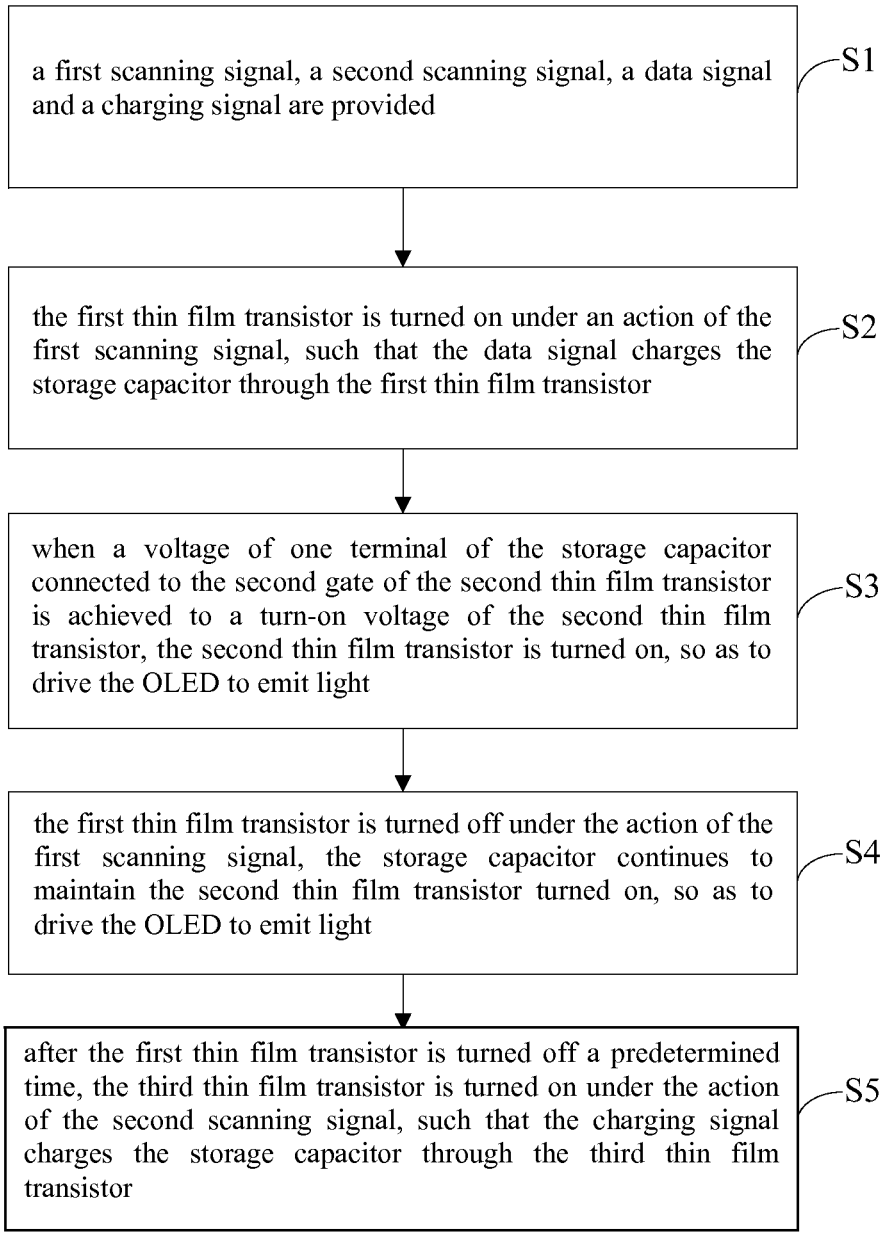
FIG. 7 is a flowchart of the pixel unit driving method according to the third embodiment of the disclosure.

Refer to FIGS. 6 and 7, the third embodiment of the disclosure provides a pixel cell driving method used to the above pixel cell driving circuit 30. The pixel cell driving method at least includes the following steps.

Step S1: a first scanning signal, a second scanning signal, a data signal and a charging signal are provided.

Specifically, the first scanning signal Vs1 is provided by the first scanning line 61, the second scanning signal Vs2 is provided by the second scanning line 63, the data signal Vdata is provided by the data line 65, and the charging signal Vc is provided by the charging line 67.

In one embodiment, the first scanning signal Vs1 and the second scanning signal Vs2 are a periodical signal with the same waveform, and the second scanning signal Vs2 relative to the first scanning signal Vs1 has a first delay time. In this embodiment, a period of the first scanning signal Vs1 and the second scanning signal Vs2 is one frame period and has the same peak value V1, the first delay time is ¾ frame period. It is understood that the first delay time further less than ¾ frame period, such as ⅔ frame period, ⅗ frame period, ½ frame period and so on.

In one embodiment, the data signal Vdata and the charging signal Vc are a periodical signal with the same waveform, and the charging signal Vc relative to the data signal Vdata has a second delay time. In this embodiment, a period of the data signal Vdata and charging signal Vc is one frame period and has the same peak value V2, the second delay time is ¾ frame period. It is understood that the second delay time is further less than ¾ frame period, such as ⅔ frame period, ⅗ frame period, ½ frame period and so on.

In this embodiment, the first scanning signal Vs1 and the data signal Vdata are synchronized with each other, the second scanning signal Vs2 and the charging signal Vc are synchronized with each other. Namely, the first delay time equals to the second delay time, and both of the first delay time and the second delay time are set less than or equal to ¾ frame period.

Step S2: the first thin film transistor T1 is turned on under an action of the first scanning signal Vs1, such that the data signal Vdata charges the storage capacitor Cs through the first thin film transistor T1.

Specifically, when the first scanning signal Vs1 is high level, the first thin film transistor T1 is turned on under the action of the first scanning signal Vs1; meanwhile, the third thin film transistor T3 is turned off under the action of the second scanning signal Vs2. The data signal Vdata charges the storage capacitor Cs through the first thin film transistor T1.

Step S3: when a voltage of one terminal of the storage capacitor Cs connected to the second gate g2 of the second thin film transistor T2 achieves to a turn-on voltage of the second thin film transistor T2, the second thin film transistor T2 is turned on, so as to drive the OLED to emit light.

Step S4: the first thin film transistor T1 is turned off under the action of the first scanning signal Vs1, the storage capacitor Cs continues to maintain the second thin film transistor T2 to turn on, so as to drive the OLED to emit light.

Specifically, when the first scanning signal Vs1 is low level, the first thin film transistor T1 is turned off under the action of the first scanning signal Vs1. The second thin film transistor T2 is turned on under the action of the storage capacitor Cs to drive the OLED for emitting light. Since the leakage current exist in the first thin film transistor T1, the electrical charge on the storage capacitor Cs leaks to the data line along the first thin film transistor T1 when the first scanning signal Vs1 is low level, such that the voltage of the storage capacitor Cs is dropped gradually.

Step S5: after the first thin film transistor T1 is turned off for a predetermined time, the third thin film transistor T3 is turned on under the action of the second scanning signal Vs2, such that the charging signal Vc charges the storage capacitor Cs through the third thin film transistor T3. In one embodiment, the predetermined time is less than or equals to ¾ frame period of the pixel cell.

Specifically, in order to avoid the OLED flicker due to the voltage of the storage capacitor Cs dropped excessively, after the first thin film transistor T1 is turned off for a predetermined time, the third thin film transistor T3 is turned on under the action of the second scanning signal Vs2, such that the charging signal Vc charges the storage capacitor Cs through the third thin film transistor T3, thereby ensuring the storage capacitor Cs to be able to provide enough voltage to drive the OLED to continue emitting light stable until the first scanning signal Vs1 changes to high level, and then repeats the above steps S1-S5.

Although the present disclosure is illustrated and described with reference to specific embodiments, those skilled in the art will understand that many variations and modifications are readily attainable without departing from the spirit and scope thereof as defined by the appended claims and their legal equivalents.

What is claimed is:

1. A pixel cell driving circuit, used to drive an organic electric lighting component, wherein the pixel cell driving circuit comprises a first thin film transistor, a second thin film transistor, a third thin film transistor and a storage capacitor; the first thin film transistor is turned on or turned off under a control of a first scanning signal; when the first thin film transistor is turned on, the storage capacitor is charged by a data signal through the first thin film transistor being turned on; the second thin film transistor is turned on under an action of the storage capacitor and drives an organic light-emitting diode (OLED) to emit light; the third thin film transistor is turned on under a control of a second scanning signal after the first thin film transistor is turned off, and the storage capacitor is charged by a charging signal through the third thin film transistor being turned on to compensate leakage of electrical charge on the storage capacitor along the first thin film transistor being turned off and thereby avoid flicker of the OLED during emitting light until the first thin film transistor is turned on again.

2. The pixel cell driving circuit according to claim 1, wherein the first thin film transistor comprises a first gate, a first source and a first drain; the second thin film transistor comprises a second gate, a second source and a second drain; the third thin film transistor comprises a third gate, a third source and a third drain; the first gate is used to receive the first scanning signal; the first source is used to receive the data signal, the first drain is directly connected to the second gate, the third drain and a first terminal of the storage capacitor by wires; a second terminal of the storage capacitor is directly connected to the second drain by wire such that the storage capacitor is connected between the second gate and the second drain; the second source is connected to one terminal of the OLED; the other terminal of the OLED is connected to a ground; the third drain is directly connected to the second gate and the first terminal of the storage capacitor by wires; the third gate is used to receive the second scanning signal; the third source is used to receive the charging signal.

3. The pixel cell driving circuit according to claim 2, wherein the pixel cell driving circuit further comprises a power source; the power source is connected to the second drain and is used to provide a driving voltage to the pixel cell driving circuit.

4. The pixel cell driving circuit according to claim 2, wherein the first scanning signal and the data signal are synchronized with each other; the second scanning signal and the charging signal are synchronized with each other;

each of a period of the first scanning signal, the second scanning signal, the data signal and the charging signal is one frame period of the pixel cell.

5. The pixel cell driving circuit according to claim 4, wherein the second scanning signal relative to the first scanning signal has a first delay time, and the charging signal relative to the data signal has a second delay time.

6. The pixel cell driving circuit according to claim 5, wherein the first delay time equals to the second delay time, and the first delay time and the second delay time are less than or equal to ¾ frame period of the pixel cell.

7. A pixel cell, comprising a first scanning line and a data line, wherein the pixel cell further comprises a second scanning line, a charging line, and a pixel cell driving circuit; the pixel cell driving circuit comprises a first thin film transistor, a second thin film transistor, a third thin film transistor and a storage capacitor; the first thin film transistor is turned on or turned off under a control of a first scanning signal; when the first thin film transistor is turned on, the storage capacitor is charged by a data signal through the first thin film transistor being turned on, the second thin film transistor is turned on under an action of the storage capacitor and drives an organic light-emitting diode (OLED) to emit light; the third thin film transistor is turned on under a control of a second scanning signal after the first thin film transistor is turned off, and the storage capacitor is charged by a charging signal through the third thin film transistor being turned on to compensate leakage of electrical charge on the storage capacitor along the first thin film transistor being turned off and thereby avoid flicker of the OLED during emitting light until the first thin film transistor is turned on again.

8. The pixel cell according to claim 7, wherein the first thin film transistor comprises a first gate, a first source and a first drain; the second thin film transistor comprises a second gate, a second source and a second drain; the third thin film transistor comprises a third gate, a third source and a third drain; the first gate is connected to the first scanning line; the first source is connected to the data line; the first drain is directly connected to the second gate, the third drain and a first terminal of the storage capacitor by wires; a second terminal of the storage capacitor is connected to the second drain by wire such that the storage capacitor is connected between the second gate and the second drain; the second source is connected to one terminal of the OLED; the other terminal of the OLED is connected to a ground; the third drain is directly connected to the second gate and the first terminal of the storage capacitor by wires; the third gate is connected to the second scanning line; the third source is connected to the charging line.

9. The pixel cell according to claim 8, wherein the pixel cell driving circuit further comprises a power source; the power source is connected to the second drain and is used to provide a driving voltage to the pixel cell driving circuit.

10. The pixel cell according to claim 7, wherein the first scanning line is used to provide a first scanning signal; the second scanning line is used to provide a second scanning signal; the data line is used to provide data signal; the charging line is used to provide a charging signal; the second scanning signal relative to the first scanning signal has a first delay time; the charging signal relative to the data signal has a second delay time.

11. The pixel cell according to claim 10, wherein the first scanning signal and the data signal are synchronized with each other; the second scanning signal and the charging signal are synchronized with each other; each of a period of the first scanning signal, the second scanning signal, the data signal and the charging signal is one frame period of the pixel cell.

12. The pixel cell according to claim 11, wherein the first delay time equals to the second delay time, and the first delay time and the second delay time are less than or equal to ¾ frame period of the pixel cell.

13. A pixel cell driving method, comprising:

providing a first scanning signal, a second scanning signal, a data signal and a charging signal;

turning on a first thin film transistor under an action of the first scanning signal, such that the data signal charges a storage capacitor through the first thin film transistor being turned on, wherein the first thin film transistor is directly connected to a first terminal of the storage capacitor by wire;

when a voltage of the first terminal of the storage capacitor directly connected to a gate of a second thin film transistor by wire achieves to a turn-on voltage of the second thin film transistor, turning on the second thin film transistor, so as to drive an organic light-emitting diode (OLED) to emit light;

turning off the first thin film transistor under an action of the first scanning signal, the storage capacitor continuing to maintain the second thin film transistor to turn on, so as to drive the OLED to emit light;

after the first thin film transistor is turned off a predetermined time, turning on a third thin film transistor under an action of the second scanning signal, such that the charging signal charges the storage capacitor through the third thin film transistor being turned on to compensate leakage of electrical charge on the storage capacitor along the first thin film transistor being turned off and thereby avoid flicker of the OLED during emitting light until the first thin film transistor is turned on again, wherein the third thin film transistor is directly connected to the first terminal of the storage capacitor by wire.

14. The pixel cell driving method according to claim 13, wherein the first scanning signal and the data signal are synchronized with each other; the second scanning signal and the charging signal are synchronized with each other; each of a period of the first scanning signal, the second scanning signal, the data signal and the charging signal is one frame period of the pixel cell.

15. The pixel cell driving method according to claim 14, wherein the second scanning signal relative to the first scanning signal has a first delay time, the charging signal relative to the data signal has a second delay time.

16. The pixel cell driving method according to claim 15, wherein first delay time equals to the second delay time, and the first delay time and the second delay time are less than or equal to ¾ frame period of the pixel cell.

17. The pixel cell driving method according to claim 16, wherein the predetermined time equals to the first delay time or the second delay time.

* * * * *